US005417138A

United States Patent [19]

Morris, Jr. et al.

[11] Patent Number: 5,417,138

[45] Date of Patent: May 23, 1995

[54] CURVED BRAID APPARATUS

[75] Inventors: Edward l. Morris, Jr., Pueblo, Colo.; John A. Hasler, Inman, S.C.; Hans-Adolf Lange, Wuppertal, Germany

[73] Assignee: The B.F. Goodrich Company, Akron, Ohio

[21] Appl. No.: 149,854

[22] Filed: Nov. 10, 1993

[51] Int. Cl.[6] ..... D04C 3/48

[52] U.S. Cl. ..... 87/31; 87/35

[58] Field of Search ..... 87/1, 5, 6, 8, 9, 13, 87/23, 29, 31, 33, 34, 35, 62

[56] References Cited

U.S. PATENT DOCUMENTS

| | | | |
|---|---|---|---|
| 1,053,692 | 2/1913 | Alspach | 254/220 |
| 1,141,382 | 6/1915 | Leeuw | 87/34 X |
| 1,610,173 | 12/1926 | Slade . | |
| 2,121,071 | 6/1938 | Croft | 87/35 |
| 2,164,286 | 6/1939 | Stybr | 87/8 |
| 2,390,769 | 12/1945 | Barrans et al. | 87/31 |
| 2,716,034 | 8/1955 | Main | 87/1 |
| 2,936,670 | 5/1960 | Walter | 87/8 |
| 3,643,921 | 2/1972 | Puretic | 254/371 |
| 4,753,149 | 6/1988 | Celani | 87/31 X |
| 4,946,722 | 8/1990 | Moyer | 428/36.1 |
| 5,052,446 | 10/1991 | Gysin | 139/93 |
| 5,217,770 | 6/1993 | Morris, Jr. et al. | 87/8 X |

FOREIGN PATENT DOCUMENTS 1006681 4/1957 Germany .

*Primary Examiner*—Joseph J. Hail, III

*Attorney, Agent, or Firm*—David M. Ronyak

[57] ABSTRACT

Apparatus for the manufacture of curved braids comprises a braiding machine provided with pull-out and take-up apparatuses. The pull-out apparatus includes a forming ring and a pair of driven frustoconical pull rolls having an adjustable nip. The members to be braided are formed into a curved flattened tube as they are drawn through the forming ring by and through the nip of the pull rolls. The curved braid as it exits the nip of the pull rolls is guided onto a take-up bobbin. A conventional tubular braiding machine may be used. Such curved braids are suitable for use in the manufacture of fibrous preforms for the manufacture of friction discs.

17 Claims, 5 Drawing Sheets

CURVED BRAID APPARATUS

The present invention is directed to an apparatus for use in the manufacture of braid, particularly a curved braid, more particularly a flattened tubular braid into a helix.

BACKGROUND OF THE INVENTION

U.S. Pat. No. 5,217,770 to Morris and Liew entitled BRAIDED SHAPED FILAMENTARY STRUCTURES AND METHODS OF MAKING describes the manufacture of friction discs and fibrous preforms therefor by needlepunching stacked layers of braided fibrous material. The braid used in the formation of such annular fibrous preforms was prepared using conventional braiding apparatus. As the braid exited the braiding apparatus, it was manually curved and flattened into an annular or helical configuration onto a take-up package. The present invention is directed to apparatus for producing a curved or helical braid which may be tailored for use, inter alia, in the manufacture of such friction discs and preforms therefor.

SUMMARY OF THE INVENTION

Apparatus 200 for forming curved or helical braid 201 comprises a forming ring 210 through which the members 202, 203 being braided are drawn from the braiding machine 180 and creel 190 by pull-out apparatus 220 into the nip 224 of a pair of juxtapositioned frustoconical rolls 222 that are synchronously driven. The frustoconical rolls 222 are preferably identical. Means 230 are provided to adjust the gap or nip 224 between the juxtapositioned frustoconical rolls 222 and to exert a predetermined amount of pressure on the braid 201 passing between the juxtapositioned frustoconical rolls 222. The frustoconical rolls 222 are synchronously driven by a single worm gear 226 the teeth of which engage complementary teeth 227 encircling the larger base end surface of each frustoconical roll 222. A compound curved chute 240 provided at the output of the nip of the frustoconical rolls 222 guides the curved braid 201 as it forms onto a take-up package 256. The apparatus 200 includes a rotatable take-up 250 which in certain preferred embodiments is synchronized relative to the speed of the frustoconical pull rolls 222 and speed of the braider 180. In its simplest form the take-up 250 comprises a motorized vertical screw 251 whose pitch corresponds to the thickness of the flattened curved braid 201 being formed such that a bottom flanged bobbin 256 mounted on the take-up 250 is lowered per revolution an amount corresponding to the thickness of the braid 201 being wound thereon.

The above and other features and advantages of the invention will become more apparent when considered in light of the following description of preferred embodiments of the invention in conjunction with the accompanying drawings which also form a part of the specification.

DETAILED DESCRIPTION OF THE PREFERRED EMBODIMENTS

In U.S. Pat. No. 5,217,770 the description of which is herein incorporated by reference, there is described the manufacture of annular fibrous preforms for use in the manufacture of friction discs such as are suitable for use in aircraft braking systems. It was later recognized that a curved braid might be more accurately formed by a machine rather than manually as was previously done. The present invention is a curved braid forming apparatus, and more particularly is a curved braid forming pull out apparatus and a take-up apparatus which when used with a known braiding machine enables the manufacture of curved braid.

Figure 1:
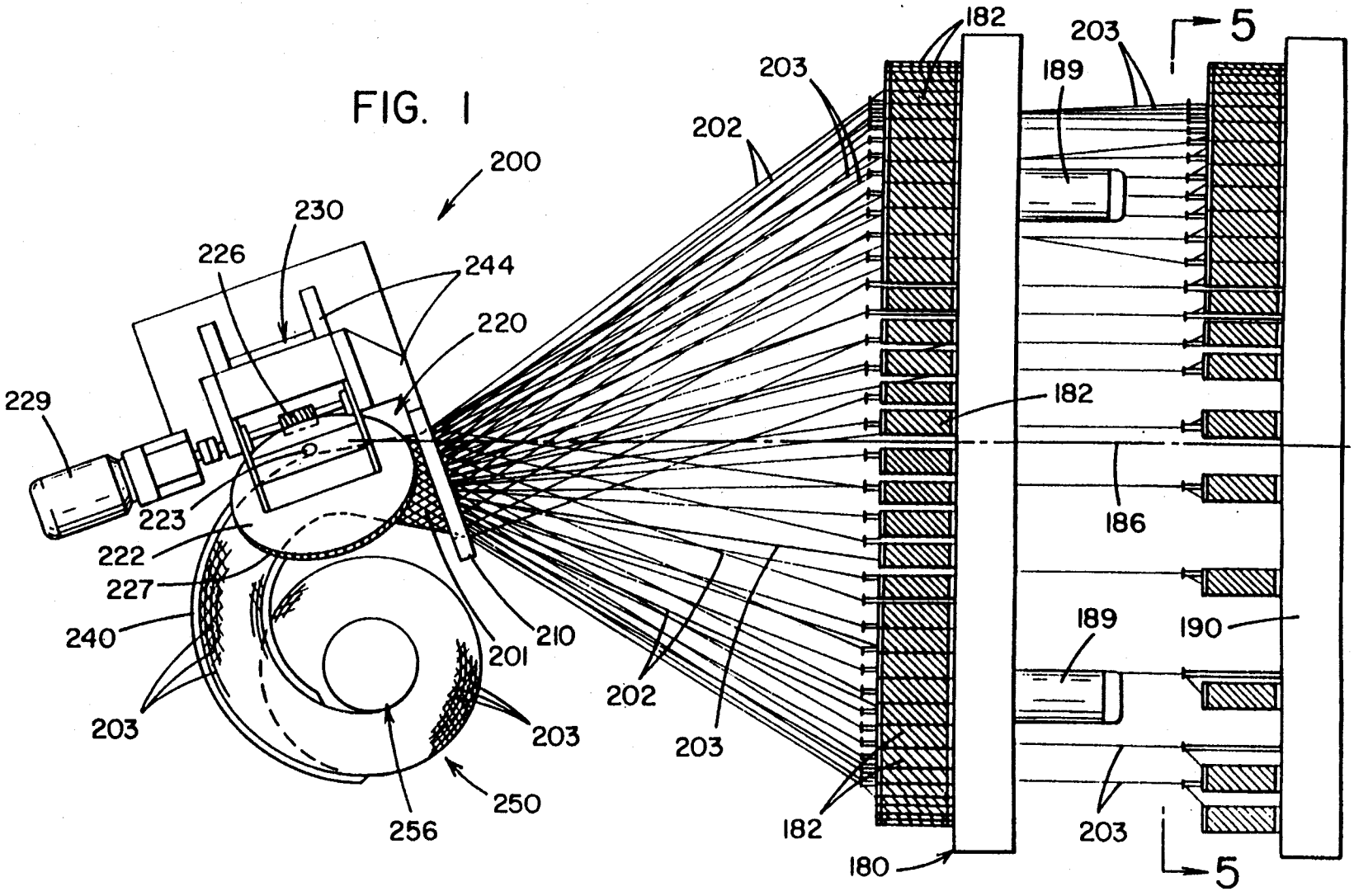
FIG. 1 is a plan view schematically depicting an embodiment of the apparatus of the invention.

Having reference to FIG. 1 there is shown a curved braid forming apparatus 200 according to the invention. The braiding machine 180 is conventional in design and operation as is the creel 190 containing packages of the unidirectional members 203 to be formed into the braid 201. Applicants have employed a 144 carrier braider capable of 72 additional unidirectional positions uniformly spaced about the circumference of the braider, although it is believed that the invention will work with braiding machines having a greater or lesser number of carriers and unidirectional positions. The curved braid apparatus 200 comprises a forming ring 210 through which all of the fibrous members 202, 203 from the braiding machine 180 are drawn by the nip 224 of a pair of juxtapositioned frustoconical rolls 222. As shown in FIG. 1, the plane of the forming ring 210 and the plane within which the axles 223 about which the respective frustoconical rolls 222 rotate are parallel and are positioned at a common angle $\alpha$ relative to the axial centerline 186 of the braider 180. Additionally, the pull roll apparatus 220 is offset laterally relative to the center line of the braider. As seen in FIG. 1, angle $\alpha$ is about 20 degrees and the offset is toward the right edge of the braider 180. The nip 224 of the frustoconical rolls 222 is positioned on centerline vertically relative to the vertical center of the braider 180. The curved braider apparatus 200 additionally includes a compound curved chute 240 which aids in transferring the curved braid 201 being formed into a motor-driven take-up apparatus 250.

Figure 3:
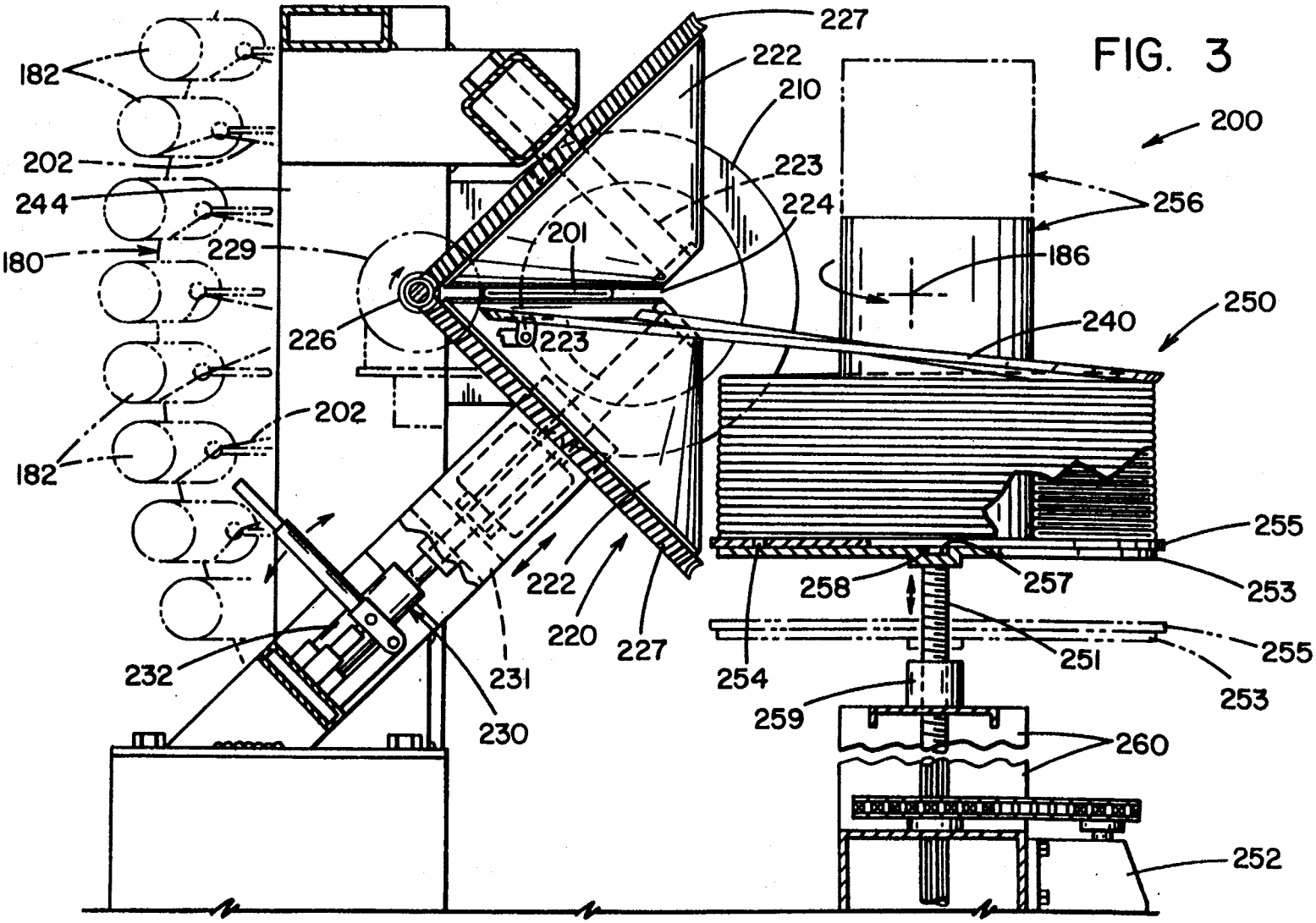
FIG. 3 is an end view taken on line 3—3 of FIG. 2 of an embodiment of the apparatus of the invention schematically depicting means for driving the juxtapositioned frustoconical pull rolls, and means for adjusting the gap between the frustoconical rolls, and means for adjusting their nip pressure.
Figure 4:
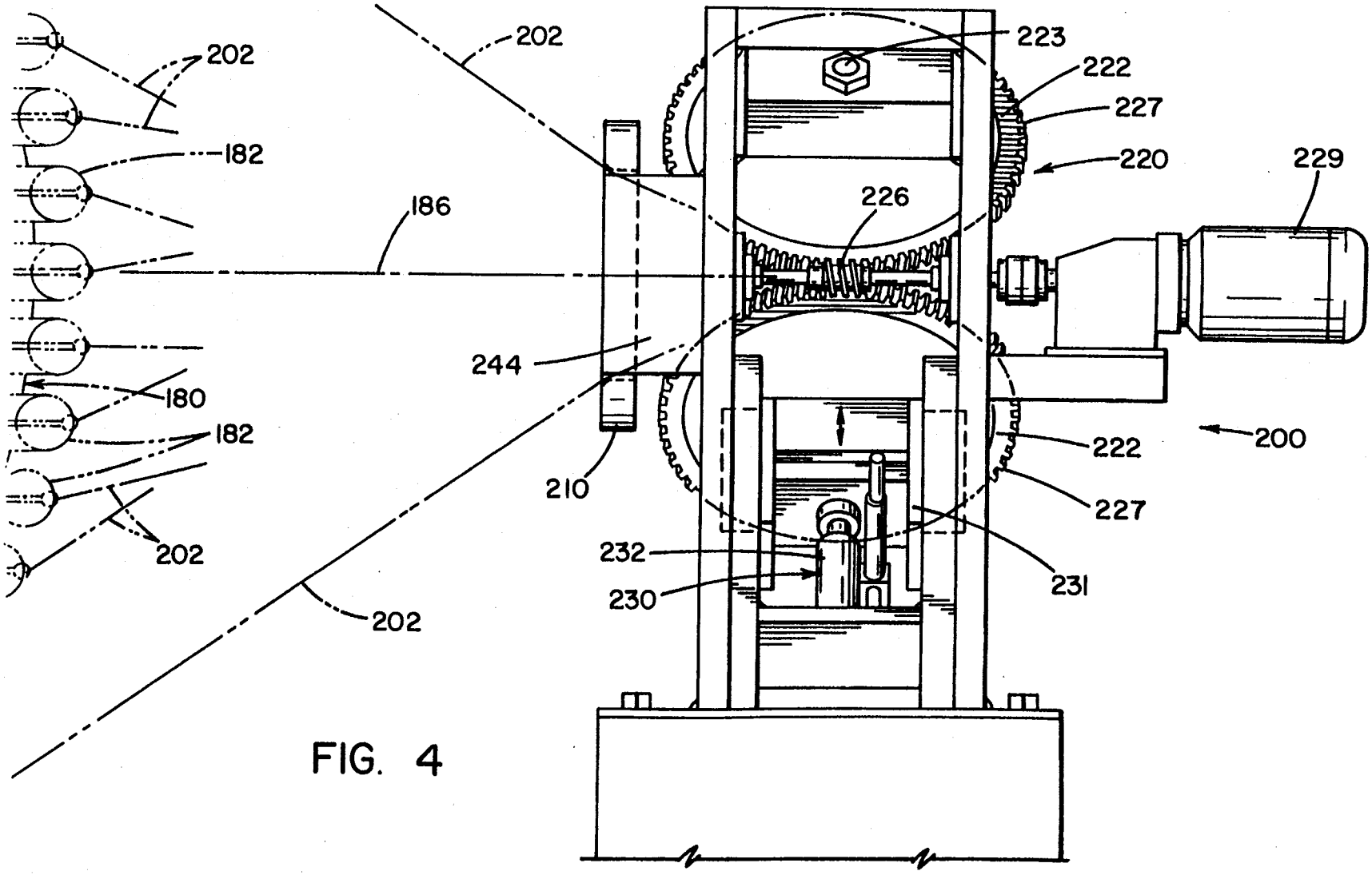
FIG. 4 is a schematic elevational view taken on line 4—4 of FIG. 2.

As seen in FIG. 3, the take-up apparatus 250 includes a motorized screw 251 which in certain embodiments is driven synchronously by motor 252 in known manner through electrical interconnections (not illustrated) with the motor 229 driving the frustoconical pull rolls 222 and the motor or motors 189 driving the braider 180. Screw 251 is rotatably fitted through stationary nut 259 secured to subframe 260. As screw 251 is rotated relative to nut 259 it lowers the bobbin 256 on which the curved braid 201 is taken up. The top of the screw 251 is provided with a flange member 253 having a vertically projecting pin 254 for engagement with a complementary aperture provided in the bottom flange 255 of the top hat-shaped bobbin 256 onto which the curved braid 201 is wound. Flange member 253 is also provided with a central recess 257 for receipt of the central hub 258 projecting from the bottom of the flange 255 of bobbin 256. Engagement of hub 258 with recess 257 centers the bobbin 256 on the flange member 253.

The frustoconical pull rolls 222 may be identical. They may be formed of cast iron that is machined to provide a frustoconical surface. The included angle of the truncated right circular cone of each frustoconical roll 222 is preferably from about sixty (60) to about ninety (90) degrees for the manufacture of precurved braided material suitable for use in the manufacture of friction discs for use in a multi-disc brake similar to that shown and described in U.S. Pat. Nos. 4,018,482; 4,878,563; and 4,613,017. Increasing the included angle will increase the surface speed differential between adjacent points along the line of contact of the frustoconical pull rolls 222. This area of contact with the material being braided may also be referred to as the nip 224 of the juxtapositioned frustoconical rolls 222. A greater included angle within each frustoconical roll 222 results in greater surface speed differential between the tip end of the cone and the base of the cone and thus shorter radii of the curved braid 201 when other factors are equal. It has been found, however, that a ninety degrees included angle of each frustoconical roll 222 is sufficient to provide the range of precurved braids desired for use in manufacturing aircraft friction disc preforms having an outside diameter of about 24 inches and an inside diameter of about 10 inches, and multiple sets of different frustoconical pull rolls have not been found to be necessary for the desired range of curved braids. The size of the pull rolls must be great enough to present a line of contact between them that is at least as long as the flattened braid is wide. The width of a braid may be defined as the distance between the lengthwise extending, laterally spaced first and second edges of the braid. For a typical commercial aircraft brake disc preform this dimension may be from about 4 to about 8 inches. Each frustoconical pull roll 222 is rotatably supported about a axle 223 congruent with the axis of symmetry of the respective frustoconical roll. The longitudinal axes of the pair of axles 223 lie in a common vertical plane and are positioned such that they intersect at an angle such that the facing surfaces of the frustoconical rolls 222 form a parallel horizontal nip 224 or line of contact. The base periphery of each frustoconical roll 222 is provided with gear teeth 227 which complement those of worm gear 226 driven by motor 229. The frustoconical pull rolls 222 are thus synchronously driven at the same rotational speed and at substantially the same surface speed at corresponding facing positions along the nip 224 such that their facing surfaces which contact the fibrous members 202, 203 are at nominally the same surface speed.

Figure 2:
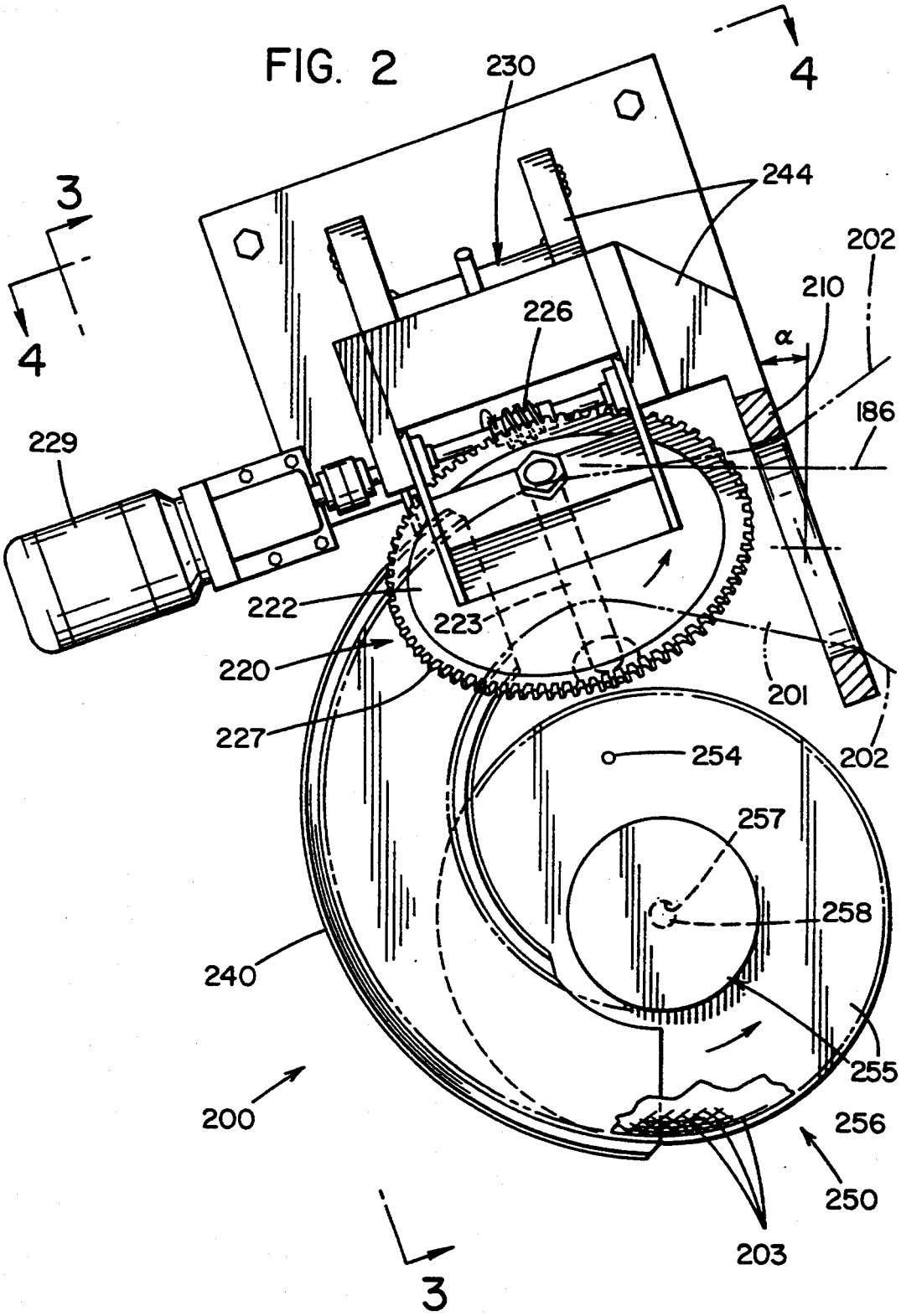
FIG. 2 is an enlarged plan view schematically depicting an embodiment of pullout apparatus and an embodiment of braid take-up apparatus according to the invention.

The lower pull roll 222 is movable to adjust the gap or nip 224 between the lower and upper frustoconical pull rolls 222. As shown in FIGS. 2 and 3, the axle 223 supporting lower frustoconical pull roll 222 is mounted on reciprocal means 230 for moving it toward and away from the upper frustoconical pull roll 222. The reciprocal means 230 may comprise a movable frame 231 connected to a hydraulic jack 232 as shown or a pneumatic load cylinder (not illustrated) to move the frame 231 and thus the lower frustoconical pull roll 222 toward and away from the upper frustoconical pull roll 222. The manner of adjustment of the nip 224 is preferably such that the lower frustoconical pull roll 222 is movable along a straight path which maintains near constant full depth engagement of the teeth 227 of the lower frustoconical pull roll 222 with the teeth of worm drive gear 226.

The forming ring 210 is positioned between the frustoconical pull rolls 222 and the braider 180. The forming ring 210 may be made of aluminum. The inlet side of the center aperture of the forming ring 210 is radiused or flared out toward the braider 180 and polished to minimize abrasion of the fibrous members 202, 203 to be drawn therethrough during the braiding operation. The forming ring 210 is rigidly mounted relative to the braider 180 and the frustoconical pull rolls 222. This may be conveniently achieved by affixing the forming ring 210 to a subframe that is rigidly attached to the frame 244 to which is mounted the frustoconical pull roll apparatus 220 and the takeup apparatus 250. The preferred inside diameter of the forming ring 210 must be determined empirically. If it is desired to form a wider flattened curved braid, a larger inside diameter forming ring is preferably employed, and vice versa.

As seen in FIG. 1, the entire frame 244 is angled relative to the axial centerline 186 of the braider 180. The nominal angle is about 20 degrees for formation of the curved braid described above. Increasing this angle results in decreasing the radius of the resultant curved braid to be formed and conversely, decreasing this angle results in increasing the radius of the resultant curved braid to be formed. Increasing the distance between the forming ring 210 and the braider 180 results in greater number of picks per inch or crossover points of the members 202, 203 being braided and conversely, decreasing the distance between the forming ring 210 and the braider 180 results in lesser number of picks per inch of the members being braided. Increasing the number of picks per inch will necessarily increase the braid angle and vice versa when all other factors are held constant.

OPERATION

Figure 5:
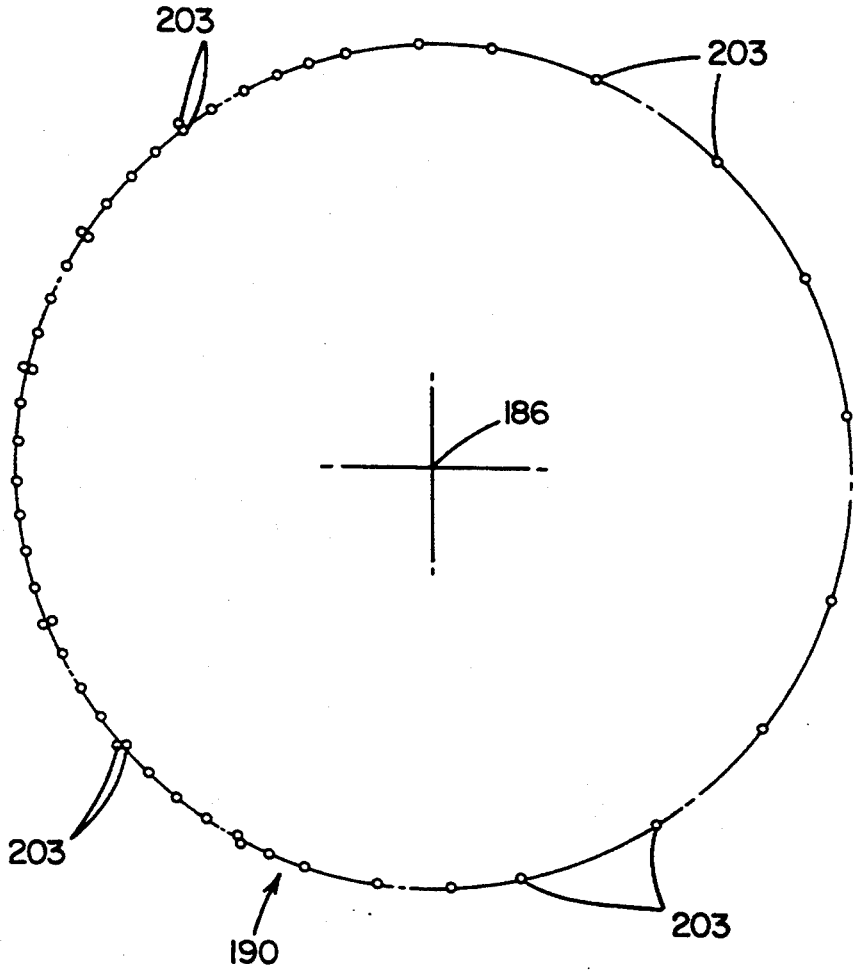
FIG. 5 is a schematic elevational view of a braider depicting an arrangement of the members to be braided.

Use of the aforedescribed curved braid apparatus 200 is as follows. All 144 carriers 182 of the braider 180 are filled with members 202 of fibrous material to be braided, e.g. oxidized PAN tow. Selected braider positions are also provided with unidirectionals 203 from the creel 190. As is illustrated in FIG. 5, a greater number of unidirectionals 203 may be provided at circumferentially spaced apart positions of the braider 180 which correspond to the outer diameter or larger radius periphery of the flattened curved braid 201 to be formed. Unidirectionals 203 may be doubled up at certain positions corresponding to nearer the outer larger radius periphery of the curved braid 201 to assist in achieving a curved braid 201 having the desired predetermined fiber volume at the corresponding location. These unidirectionals 203 also contribute to the stability of the braid 201 during windup and any subsequent processing. All of the members 202, 203 to be braided are manually drawn through the forming ring 210 and the nip 224 of the frustoconical pull rolls 222. The lower pull roll 222 is then raised towards the upper pull roll 222 to decrease the gap of the nip 224 and to apply pressure to the fibrous members 202, 203 in the nip. The entire apparatus is then energized causing the braider 180 to begin operation and the pull rolls 222 to operate in synchronism therewith. When braided material 201 extends a short distance aft of the nip 224 of the frustoconical pull rolls 222, the unbraided fibrous material is cut away. The curved flattened tubular braid 201 slides down chute 240 and is helically wound onto the take-up bobbin 256. When the take-up bobbin 256 is full, the braiding operation is stopped, the curved braid 201 is severed, and the full bobbin 256 is removed from the take-up mechanism 250. The screw 251 of the take-up mechanism 250 is returned to its original full height and an empty bobbin 256 is installed such that the drive pins 254 projecting upwardly from the flange 253 of the take-up mechanism 250 are in engagement with the complementary apertures in the bottom flange 255 of the tophat bobbin 256, which apertures also serve to center the tophat bobbin 256 on the take-up mechanism 250 and to provide a driving torque for take-up of the curved braid 201 as it is formed. Braiding operations are then resumed.

The foregoing description and embodiments are intended to illustrate the invention without limiting it thereby. It will be understood that various modifications can be made from the preferred embodiments illustrated and described in detail. The variations are intended to be included within the present specification and claims. Examples of such variations follow. The angle of the forming ring 210 and frustoconical pull roll mechanism 220 relative to the centerline 186 of the braider 180 should be reduced if it is desired to provide a curved braid 201 having a larger radius of curvature. Applicants have found that the 20 degree angle illustrated and described herein is suitable for the manufacture of a curved flattened tubular braid having an inside diameter of about 10 inches and an outside diameter of about 24 inches. The forming ring 210 positioned between the braider 180 and frustoconical pull rolls 222 directs the unbraided members 202, 203 to be braided as they are drawn from the braider carriers 182 and filamentary packages 192 creel 190 to a common forming or conversion point at or near the nip 224 of the forming rolls 222.

EXAMPLE

A curved braid having an inside periphery radius of about 13 cm (5 inches) and an outside periphery radius of about 30 cm (12 inches), was made employing the following setup parameters that were empirically determined to be suitable. A forming ring having an inside diameter or aperture of about 29 cm (11.5 inches), which corresponds to about two times the width of the flattened curved braid to be formed was found to be suitable. Ring 210 was positioned about 1.5 m (56 inches) from the braider 180. Ring 210 was positioned about 25 cm (10 inches) from the pull roll nip 224. The forming ring 210 and vertical plane defined by the pull roll axles 223 were angled about twenty degrees relative to the axial centerline 186 of the braider 180. The apparatus was provided with frustoconical pull rolls each having an included angle of ninety degrees.

For flexibility and convenience of operation the control system is preferably provided with electrically interconnected drive motors. The drive motor or motors 189 of the braider 180 can be controlled by a first potentiometer (not illustrated), the motor 229 of the frustoconical pull rolls 222 by a second potentiometer (not illustrated), and the motor 252 of the tophat bobbin 256 take-up mechanism 250 by a third potentiometer (not illustrated). After the speeds of the various drive motors 189, 229 and 252 are relatively adjusted such that the desired braid is being formed, the master speed controller (not illustrated) can be adjusted upward or downward to increase or decrease the overall speed of curved braid manufacture without affecting the characteristics of the braid being formed. Also, individual motors can be jogged to facilitate loading, doffing and maintenance of the apparatus. Higher braider speed relative to the speed of the pull rolls 222 results in a greater number of crossovers or picks per inch, and conversely lower braider speed relative to pull roll speed results in a lower number of crossovers or picks per inch. Because the braid 201 is curved, the number of picks per inch necessarily varies between the inside diameter periphery and the outside diameter periphery of the braid, the outside diameter periphery having less picks per inch at all times, inversely in proportion to the amount of curvature. In contrast, a straight flattened tubular braid has the same number of picks per inch at each peripheral edge.

No special surface treatments are necessary for the frustoconical pull rolls 222 when formed of machined (milled) iron castings. The use of elastomeric coatings or covers on the frustoconical pull rolls 222 is not necessary nor recommended because the relatively high pressure at the nip 224 may result in dislodging or tearing of such covers. Sufficient frictional pulling force is obtained merely by squeezing the braid 201 between the frustoconical rolls 222.

What is claimed is:

1. Pull roll apparatus for pulling braiding members from a braiding machine comprising:

a frame;

a pair of juxtapositioned frustoconical pull rolls each rotatably mounted by an axle congruent with the axis of symmetry of said respective pull rolls to said frame, said frustoconical pull rolls defining a nip therebetween, the size of said nip being adjustable without changing the shape of the nip through movement of at least one of the pull rolls to exert pressure on the braided members as they pass through said nip;

means for synchronously driving said pull rolls; and take-up apparatus for receipt of the braiding members after their passage through said nip, the take-up apparatus comprising a bobbin and means for rotating said bobbin.

2. Apparatus according to claim 1 further comprising a forming ring for passage of the braiding members therethrough prior to passage of the braiding members through said nip.

3. Apparatus according to claim 2 wherein the forming ring is positioned parallel to the nip.

4. Apparatus according to claim 3 wherein the inlet side of the forming ring which faces away from the nip is flared out.

5. Apparatus according to claim 2 wherein the forming ring is affixed to the frame.

6. Apparatus according to claim 2 wherein the frustoconical rolls are substantially identical, each having a frustoconical surface defining an included angle of from sixty to ninety degrees.

7. Apparatus according to claim 6 wherein the frustoconical rolls have facing surfaces that form a parallel nip.

8. Apparatus according to claim 1 further comprising a chute for guiding the braiding members from the nip to the take-up apparatus.

9. Apparatus according to claim 1 further including means for lowering the bobbin as it is rotated.

10. Apparatus according to claim 9 further including means for synchronously operating the take-up apparatus relative to the pull rolls.

11. Pull roll apparatus for pulling braiding members from a braiding machine comprising:

a frame;

a pair of synchronously driven, juxtapositioned, frustoconical pull rolls each rotatably mounted by an axle congruent with the axis of symmetry of said respective pull rolls to said frame, said frustoconical pull rolls defining a nip therebetween, the size of said nip being adjustable without changing the shape of the nip through movement of at least one of the pull rolls to exert pressure on the braided members as they pass through said nip;

a moveable subframe to which one of the pair of frustoconical pull rolls is mounted; and a fluid-powered cylinder and piston assembly for positioning said subframe to adjust the nip.

12. Pull roll apparatus for pulling braiding members from a braiding machine comprising:

a frame;

a pair of juxtapositioned frustoconical pull rolls each rotatably mounted by an axle congruent with the axis of symmetry of said respective pull rolls to said frame, said frustoconical pull rolls defining a nip therebetween, the size of said nip being adjustable without changing the shape of the nip through movement of at least one of the pull rolls to exert pressure on the braided members as they pass through said nip;

a plurality of gear teeth integral with and encircling the circumferentially extending base of each frustoconical pull roll, and a drive screw having teeth that concurrently engage gear teeth of both of the pull rolls for synchronously driving said pull rolls;

wherein the adjustable nip comprises a movable subframe to which one of the pair of frustoconical pull rolls is mounted and means for positioning said subframe wherein the subframe is movable along a path which minimizes variation in the engagement of the drive teeth of the drive screw with the teeth of the driven frustoconical rolls as the size of the nip between the frustoconical rolls is varied without changing the shape of the nip.

13. Apparatus for forming braiding members drawn from a braiding machine having an axial centerline into a curved braid, comprising:

a) a pull roll apparatus through and by which the braiding members are pulled comprising a frame and a pair of substantially identical frustoconical rolls each having a frustoconical surface defining an included angle of from sixty to ninety degrees with each roll being rotatably supported about an axle congruent with the axis of symmetry of said respective pull roll and mounted to said frame, each said axle having a longitudinal axis, said axle axes lying in a common substantially vertical plane positioned such that facing portions of said frustoconical surfaces form a parallel horizontal nip for pulling the braiding members therethrough, means for synchronously driving said rolls at substantially the same surface speed at corresponding facing positions along said nip, and means for moving one of said rolls to adjust said nip;

b) a forming ring defining a plane for passage therethrough of the braiding members, said forming ring being positioned between said braiding machine and said pull roll apparatus, and means for attaching said forming ring to said pull roll frame such that said forming ring plane is parallel to said common vertical plane defined by said pull roll axles, and c) a take-up apparatus for receipt of the curved braid to be formed comprising a rotatable flange upon which a bottom-flanged bobbin is rotatably supported, means for synchronously driving said bobbin relative to said frustoconical rolls, and means for lowering said bobbin as it is rotated.

14. The apparatus of claim 13 further comprising a chute for guiding the braided members from the nip to the take-up apparatus.

15. The apparatus of claim 14 wherein said means synchronously driving said rolls at substantially the same surface speed at corresponding facing positions along said nip comprises a worm drive screw whose teeth drivingly engage complementary driven teeth encircling the circumferentially extending base of each frustoconical roll, and said means for moving one of said rolls to adjust said nip comprises a movable subframe to which one of the pair of frustoconical pull rolls is mounted and means for positioning said subframe wherein said subframe is movable along a path that is substantially parallel to the axis of said one of the pair of frustoconical pull rolls which minimizes variation in the engagement of the teeth of the drive screw with the teeth of the driven frustoconical rolls as the nip between them is varied.

16. The apparatus of claim 15 wherein the means for positioning the movable subframe comprises a fluid actuator.

17. An apparatus for forming braiding members into a curved braid, comprising:

a) a braiding machine having an axial centerline;

b) a pull roll apparatus through and by which the braiding members are pulled comprising a frame and a pair of substantially identical frustoconical rolls each having a frustoconical surface defining an included angle of from sixty to ninety degrees with each roll being rotatably supported about an axle congruent with the axis of symmetry of said respective pull roll and mounted to said frame, each said axle having a longitudinal axis, said axle axes lying in a common substantially vertical plane positioned such that facing portions of said frustoconical surfaces form a parallel horizontal nip for pulling the braiding members therethrough, means for synchronously driving said rolls at substantially the same surface speed at corresponding facing positions along said nip, and means for moving one of said rolls to adjust said nip;

c) a forming ring defining a plane for passage therethrough of the braiding members, said forming ring being positioned between said braiding machine and said pull roll apparatus, said forming ring being attached to said pull roll frame such that said forming ring plane is parallel to said common vertical plane defined by said pull roll axles; and d) a take-up apparatus for receipt of the curved braid to be formed comprising a rotatable flange upon which a bottom-flanged bobbin is rotatably supported, means for synchronously driving said bobbin relative to said frustoconical rolls, and means for lowering said bobbin as it is rotated;

said forming ring and pull roll apparatus being positioned with the forming ring plane and said common vertical plane defined by said pull roll axles being at an angle to a plane that is perpendicular to the axial centerline of the braiding machine, the nip of said pull rolls being offset laterally relative to said axial centerline.

* * * * *